US006671970B2

(12) United States Patent
Chong

(10) Patent No.: US 6,671,970 B2
(45) Date of Patent: Jan. 6, 2004

(54) CAN LID LIFTER FOR CAN OPENER

(75) Inventor: Wun C. Chong, Delta (CA)

(73) Assignee: CanPacific Engineering Inc., Delta (CA)

( * ) Notice: Subject to any disclaimer, the term of this patent is extended or adjusted under 35 U.S.C. 154(b) by 45 days.

(21) Appl. No.: 10/058,001

(22) Filed: Jan. 29, 2002

(65) Prior Publication Data

US 2003/0140508 A1 Jul. 31, 2003

(51) Int. Cl.[7] ..... B67B 7/72
(52) U.S. Cl. ..... 30/410; 30/417; 30/418
(58) Field of Search ..... 30/410, 417, 418, 30/430

(56) References Cited

U.S. PATENT DOCUMENTS

| | | | | | |
|---|---|---|---|---|---|
| 1,935,680 | A | | 11/1933 | Von Wolforsdorf | |
| 2,556,766 | A | * | 6/1951 | Mathieu | 30/418 |
| 2,715,265 | A | * | 8/1955 | Hult | 30/417 |
| 2,861,337 | A | * | 11/1958 | Behlau | 30/410 |
| 3,510,941 | A | | 5/1970 | Fyfe | 30/15.5 |
| RE27,504 | E | | 10/1972 | Smith | 30/15.5 |
| 3,719,991 | A | | 3/1973 | French | 30/15.5 |
| 4,726,119 | A | * | 2/1988 | Lee | 30/418 |
| 4,734,986 | A | * | 4/1988 | Peters | 30/410 |
| 4,782,594 | A | | 11/1988 | Porucznik et al. | 30/417 |
| 5,121,546 | A | | 6/1992 | Chong | 30/418 |
| 5,367,776 | A | | 11/1994 | Chong | 30/417 |
| 5,946,811 | A | | 9/1999 | Chang | 30/417 |
| 6,094,828 | A | | 8/2000 | Chong | 30/417 |
| 6,101,727 | A | | 8/2000 | Chong | 30/418 |
| 6,158,130 | A | * | 12/2000 | Chong | 30/418 |
| 6,182,368 | B1 | * | 2/2001 | So | 30/418 |

FOREIGN PATENT DOCUMENTS

| | | |
|---|---|---|
| GB | 1318 | of 1912 |

* cited by examiner

*Primary Examiner*—Hwei-Siu Payer
(74) *Attorney, Agent, or Firm*—Oyen Wiggs Green & Mutala

(57) ABSTRACT

This invention relates to a novel can lid lifter for a hand operated can opener. More particularly, the invention is directed to a novel can lid lifter for a hand operated can opener that cuts the outer seam wall of a can, rather than the top interior lid of the can, in order to remove the lid. A can opener comprising: (a) a handle; (b) a clamping lever; (c) a hand crank; (d) a wheel cutting blade; (e) a traction wheel which rotates when the hand crank is rotated; (f) a can lid top contact member mounted on an exterior of the can opener; (g) a can lid lifting pin associated with the can lid top contact member for releasably catching the edge of a cut can lid.

5 Claims, 8 Drawing Sheets

CAN LID LIFTER FOR CAN OPENER

FIELD OF THE INVENTION

This invention relates to a novel can lid lifter for a hand operated can opener. More particularly, the invention is directed to a novel can lid lifter for a hand operated can opener that cuts the outer seam wall of a can, rather than the top interior lid of the can, in order to remove the lid.

BACKGROUND OF THE INVENTION

Can openers are well known. In general, they comprise a traction wheel and a cutting wheel. The traction wheel when rotated acts as a reaction surface against the can and drives the can opener around the lip of the can while the sharpened cutting wheel simultaneously cuts through the can. The most common commercially available type of can opener is one that cuts the top interior lid of the can to gain access to the can contents. A main problem with this type of can opening is that the cutting blade cuts down through the lid from the top circumference thereof and tends to come into contact with the contents of the can. This is a problem if the cutting blade is dirty from previous use or has harmful bacteria on the cutting blades. A further problem is that if the cutting blade is not particularly sharp, it will not cut the lid edge cleanly and will tend to form small metal shavings that fall into and contaminate the contents of the can. The metal shavings can be harmful if ingested. Yet a further problem is that if the entire circumference of the can lid is cut, the top lid is no larger and often falls into the can contents and can be difficult and messy to remove from the interior of the can. The exterior of the can which can be dirty is exposed to the can contents, which are ultimately consumed.

To overcome these problems, can openers have been developed that cut the outside seam of the can so that the lid and part of the circumferential seam are cut and removed from the can. In this way, the cutting blade does not contact the contents of the can, there are no metal shavings that fall into the interior of the can, and the can lid does not drop into the interior of the can. Examples of this design of can opener include U.S. Pat. No. 3,719,991 to French; U.S. Reissued Pat. No. 27,504 to Smith; U.S. Pat. No. 1,935,680 to Von Wolforsdorf; U.S. Pat. No. 4,782,594 to Porucznik et al. and U.S. Pat. No. 3,510,941 to Fyfe. All of these patents disclose a can including a pin sliding in an arcuate slot for engaging and locking the can opener on the can to be opened. While these arrangements work adequately, over time and use there is a tendency for the moving parts to wear with the result that the engaging and locking function of the opener is impaired thereby leading to difficulty in cutting the can and keeping the opener in position on the can.

My U.S. Pat. No. 5,121,546, granted Jun. 16, 1992, discloses an effective solution of the above problem. In the can opener design disclosed in that patent, there are thrust surfaces and a separating means that can be introduced between the thrust surfaces. The separating means, typically a ball bearing, is introduced between the thrust surfaces and moves a movable thrust surface away from a fixed thrust surface to separate a movable wheel, usually the traction wheel, and a cutting wheel. By this method, the can opener is brought to the cutting position. The wheel can then be rotated to cut the can. While the can opener disclosed in my U.S. Pat. No. 5,121,546 has proved to be extremely effective, experiments with groups of people have shown that a certain amount of manual dexterity is required in order to effectively operate the can opener. This can be a disadvantage because many persons endeavouring to open cans, such as the elderly or handicapped, do not have a great deal of manual dexterity.

My subsequent U.S. Pat. No. 5,367,776, granted Nov. 29, 1994, discloses a can opener which requires less manual dexterity in order to be operated. The can opener comprises a housing having a handle. The cutting wheel has a cutting edge for severing a can wall, the cutting wheel defining a cutting wheel axis. The opener also has a traction wheel with a gripping surface which engages the can, the traction wheel defining a traction wheel axis. The opener includes a hand crank for rotatably mounting the traction wheel and the cutting wheel in the housing such that their axes are substantially perpendicular and the wheels are positioned adjacent and spaced apart from each other to define a gap to accept the seam of the can to be opened. One of the wheels is movable towards the other in order to engage and lock the can between the cutting wheel and the traction wheel so that the cutting wheel acts to sever the can wall. The traction wheel acts to move the can past the cutting wheel. The first thrust surface is associated with the housing and the spaced, adjacent, second thrust surface is associated with the moveable wheel. The first and second thrust surfaces comprise cooperable cam surfaces which are rotatable relative to each other to reciprocate the first and the second thrust surfaces relative to each other between a first position, where the gap is relatively wide, and a second position where the gap is narrow and the can is engaged and locked between the cutting wheel and the traction wheel. A hand crank is associated with one of the wheels to permit rotation thereof.

My third U.S. Pat. No. 6,101,727, granted Aug. 15, 2000, protects a dual-handle pump-action type can opener that can be operated by either hand and which cuts the exterior wall of the seam of a can, rather than the top lip of the can. The dual-handle pump-action can opener includes: (a) a housing having a first handle; (b) a cutting wheel associated with the housing and the first handle and having a cutting edge for severing the exterior wall of the can seam; (c) a traction wheel associated with the housing and the first handle and having a gripping surface for engaging the interior wall of the can seam; and (d) a second handle which is movable towards and away from the first handle. When the second handle is initially moved towards the first handle after the can opener is installed on the seam of the can, it causes the traction wheel to contact the interior wall of the can seam and the cutting wheel to contact the exterior wall of the can seam. On subsequent reciprocal movement of the second handle towards and away from the first handle through a series of levers and gears, the traction wheel is caused to rotate in incremental steps to advance the traction wheel along the interior wall of the can seam, thereby causing the cutting wheel also to rotate and cut the exterior wall of the can seam.

A problem with these can openers is that although they are very efficient in cutting the seam of the can lid, it is nonetheless often difficult to remove the cut can lid from the can. This is because the can has food grade sealing compound between the intersections of the lid and can body which together form the seam. This sealing compound is sticky and deters removal of the lid and part of the seam after it is cut from the can.

SUMMARY OF THE INVENTION

The invention is directed to a can opener comprising: (a) a handle; (b) a clamping lever associated with the handle; (c) a hand crank associated with the clamping lever and handle;

(d) a wheel cutting blade mounted on the can opener; (e) a traction wheel which rotates when the hand crank is rotated; (f) a can lid top contact member mounted on an exterior of the can opener for contacting the cut lid of a can; and (g) a can lid lifting pin associated with the can lid top contact member for releasably catching the edge of a cut can lid.

The can lid lifting pin can have a ridge thereon which can assist in catching the edge of the can lid. The lid lifting pin can be cylindrical and can have a protrusion at the distal end thereof of a diameter greater than the diameter of the cylinder. The protrusion can be in the shape of a hemisphere.

The can opener can include a "J-shaped" can abutment member associated with the wheel cutting blade and the traction wheel for assisting an operator in contacting the can opener with a can at an optimum can lid seam cutting angle. The "J-shaped" can abutment member when mounted on a can, can contact the seam of the can at an end proximate to the can opener, and at a distal end, can contact the top interior of the can lid.

The can opener can include a contact face on the wheel cutting blade which rotatably bears on the exterior underside of a seam of a can. The can wall contact face can cooperate with the "J" shaped can abutment to movably secure the can opener to the can during the can seam shearing operation.

The invention is also directed to a can opener comprising: (a) a handle; (b) a clamping lever associated with the handle; (c) a hand crank associated with the clamping lever and handle; (d) a wheel cutting blade mounted on the can opener; (e) a traction wheel which rotates when the hand crank is rotated; and (f) a "J-shaped" can abutment member associated with the wheel cutting blade and the traction wheel for assisting an operator in contacting the can opener with a can at an optimum can lid seam cutting angle.

The invention also pertains to a can lifter for use in association with a can seam cutting can opener which comprises: (a) a can lid top contact member; and (b) a can lid lifting pin associated with the can lid top contact member, the can lid lifting pin cooperating with the can lid top contact member to grip a can lid and can seam of a cut can lid.

BRIEF DESCRIPTION OF THE DRAWINGS

In drawings which illustrate specific embodiments of the invention, but which should not be construed as restricting the spirit or scope of the invention in any way.

DESCRIPTION OF PREFERRED EMBODIMENTS OF THE INVENTION

Throughout the following description, specific details are set forth in order to provide a more thorough understanding of the invention. However, the invention may be practiced without these particulars. In other instances, well known elements have not been shown or described in detail to avoid unnecessarily obscuring the invention. Accordingly, the specification and drawings are to be regarded in an illustrative, rather than a restrictive, sense.

The can opener according to the present invention utilizes some of the seam cutting components which were disclosed and illustrated in my prior U.S. Pat. No. 5,367,776, granted Nov. 29, 1994 and U.S. Pat. No. 6,101,727, granted Apr. 15, 2000. The specifications of these two patents are incorporated herein by reference. However, the invention that is disclosed and claimed herein has a number of additional features which provide advantages over the can openers that are disclosed in my prior U.S. Pat. Nos. 5,367,776 and 6,101,727.

The can opener according to the subject invention includes a can engaging clamp lever, a single finger twist handle (hand crank) and a main handle. The can opener according to the invention automatically engages the seam of the can by placing the J-shaped can abutment on the top edge of the can and depressing the can engaging clamp lever. The can opener according to the subject invention cuts the upper seam of the can on the exterior side, similar to the manner in which my prior can opener designs cut the exterior side seam of the can. However, with the present invention, the J-shaped can abutment contacts the top of the can lid and the top seam of the can on one side of the can, to align the cutting wheel, and the traction wheel and cutting wheel then proceed around the circumference of the can seam, and shear it, by having the operator turn the hand crank. The can opener according to the subject invention is disengaged from the can seam after the lid and part of the top seam of the can have been sheared by lifting the clamping lever at the top of the can opener. The can opener according to the invention, by including a J-shaped downwardly curved can abutment member, which at its distal end descends below the elevation of the can seam, and contacts the top of the can lid, assists in properly aligning the can opener on the can so that an accurate and clean shear of the can seam can be made reliably and consistently. The J-shaped can abutment member also assists in holding the can and seam in engagement with the cutting wheel and traction wheel of the can opener while it is being operated.

Figure 1:
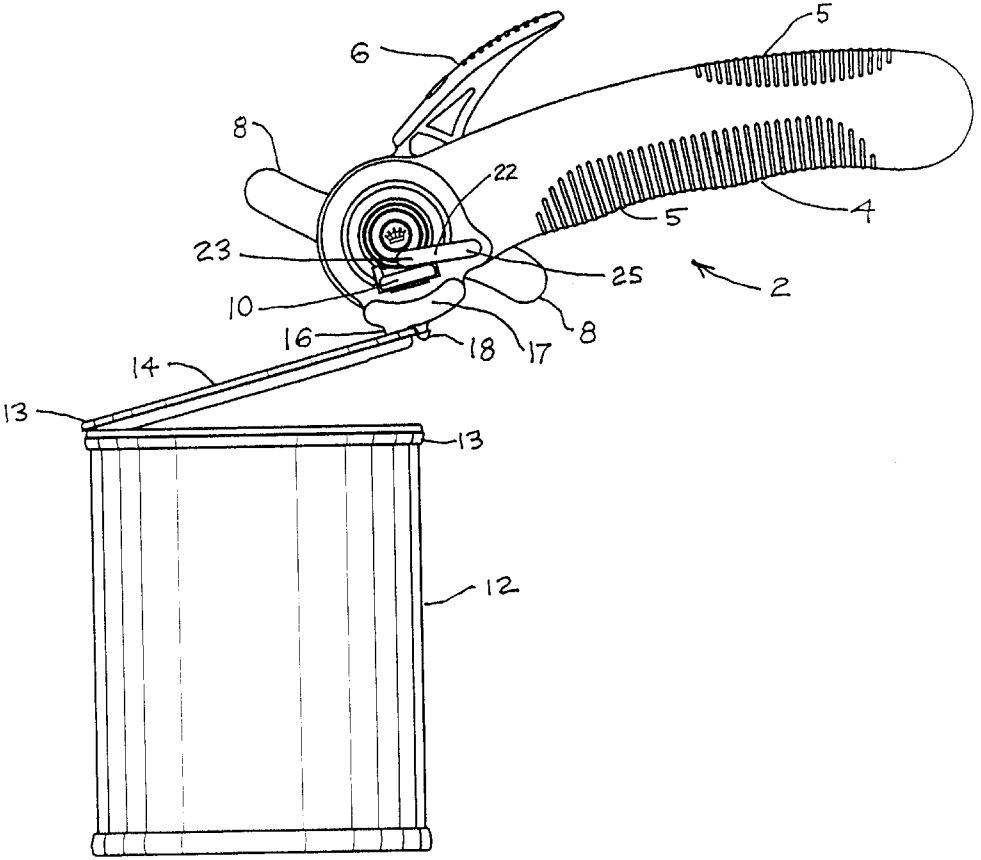
FIG. 1 illustrates a front elevation view of the hand operated can opener with the can lifter lifting the cut lid of a can.

FIG. 1 illustrates a front elevation section view of the hand operated can opener with the can lid lifter lifting the cut lid of a can. As seen in FIG. 1, the can opener 2 is constructed with an ergonomically designed main handle 4, which has grip enhancing rubber ridges 5 embedded therein. The can opener 2 includes a clamping lever 6, a hand crank 8, a wheel-type cutting blade 10, a can wall contact face 17 and a semicircular can lid abutment 22 with a distal end 23. As illustrated in FIG. 1, the can opener 2 according to the invention also has a lid top contact 16 and a lid lifting pin 18 located immediately below the cutting blade 10. The lid top contact 16 contacts the top interior of the can lid 14, adjacent the seam 13, while the lid lifting pin 18, which has an inverted mushroom-type protuberance, catches the underside edge of the seam 13. The lid top contact 16 cooperates together with the lifting pin 18 to enable the operator to overcome the resistance of the sealing compound in the seam and lift the lid 14 from the can 12. When food containing metal cans are constructed, the interiors of the can and the interiors of the lids at the top and bottom of the can are typically coated with a food grade lacquer to prevent contact of the food with the metal. In addition, a sealing compound is applied on the seams of the top and bottom lids of the can, before the top and bottom lids are stamped and affixed to the cylindrical wall of the can. This sealing compound is sticky and inhibits removal of the can lid 14 after it has been sheared from the can 12 at the top seam. The combination of the top lid contact 16 and lid lifting pin 18 enables the operator to readily catch an under edge of the top lid and assist the operator in overcoming the resistance of the sealing compound and lift the lid 14 away from the can 12.

Figure 2:
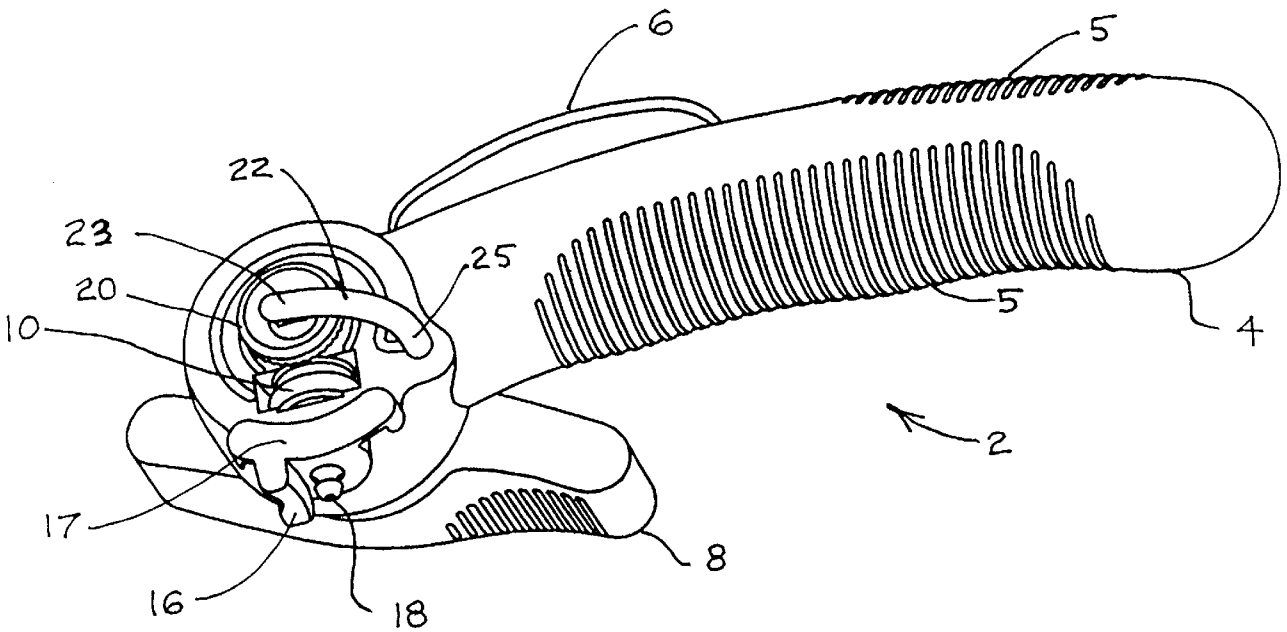
FIG. 2 illustrates an isometric view of the hand operated can opener equipped with the can lid lifter.

FIG. 2 illustrates an isometric view of the hand operated can opener equipped with the can lid lifter. FIG. 2 is helpful in illustrating two main features of the can opener 2, according to the invention. It illustrates how the lid top contact 16 and the lid lifting pin 18 are built as part of a can wall contact face 17 secured to the bottom of the can opener 2 immediately below the wheel cutting blade 10.

FIG. 2 also illustrates the construction of the J-shaped can abutment 22, with its distal end 23, which is used to enable the operator to readily contact the top seam and top lid of the can to be cut, and properly align the traction wheel 20 and cutting wheel 10 with the seam of the can 12. FIG. 2 also illustrates the ergonomic design of the main handle 4 and the rubber grip ridges 5.

Figure 3:
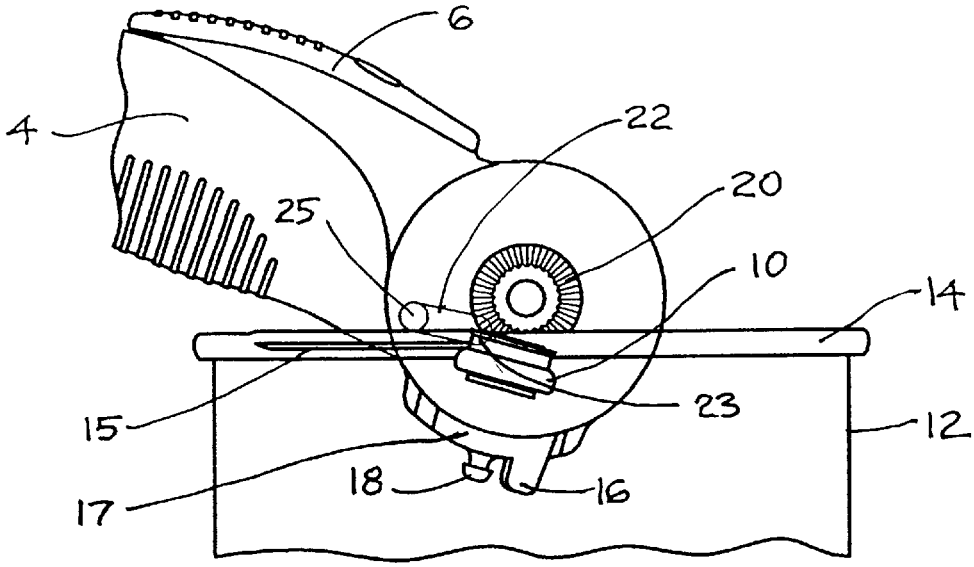
FIG. 3 illustrates a detail side elevation partial section view of the hand operated can opener shearing a cut in the top outer seam of a can.

FIG. 3 illustrates a detail side elevation partial section view of the hand operated can opener shearing a cut in the top outer seam of a can. FIG. 3 is of value in illustrating how the J-shaped can abutment 22 is disposed at a critical angle and at one inner side contacts the top of the seam 13 of the can 12, while at its opposite free end 23, contacts the top surface of the lid 14. In this way, when the clamping lever 6 is depressed, the traction wheel 20 and cutting blade 10 are automatically engaged at the optimum shearing angle. The can wall contact face 17 also assists in movably securing the can opener 2 in position on the can 12. Once the traction wheel 20 and the cutting wheel 10 are in position on the can at the angle shown in FIG. 3, the hand crank 8 (not shown) is turned by the operator and the rotating cutting blade 10 and traction wheel 20 move around the circumference of the lid and the blade 10 shears a cut 15 in the exterior wall of the seam 13 of the can lid 14.

Figure 4:
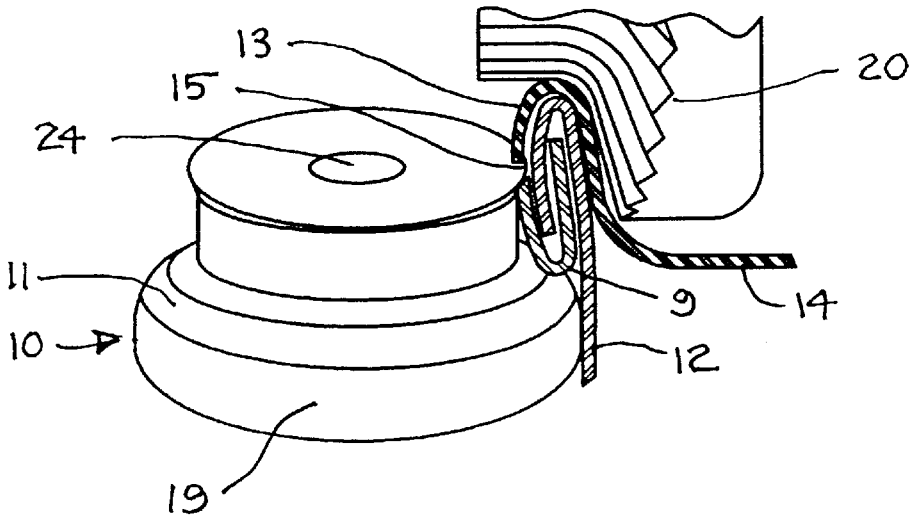
FIG. 4 illustrates a detailed isometric partial section view of the cutting blade and traction wheel of the can opener cutting the top seam of a can.

FIG. 4 illustrates a detailed isometric partial section view of the cutting blade and traction wheel of the can opener cutting the top seam of a can. FIG. 4 illustrates how the cutting wheel 10, when it is rotated about vertical pin 24, in combination with the turning traction wheel 20, shears a cut 15 in the outer metal layer of the seam 13, where the wall of the can 12 and the edge of the lid 14 are connected together in a coiled manner. FIG. 4 also illustrates the underseam contact edge 11 on the cutting wheel. This underseam contact edge 11 rotatably contacts the underside 9 of the can seam 13, and in cooperation with the rotating can wall contact face 19 slidably secures the cutting wheel 10 to the can 12 and seam 13 and ensures that the can 12 does not slip downwardly. The sealing compound, which is present between the folded contacting layers of the can wall 12 and lid 14 is not shown. However, it will be understood that the sealing compound is present between the connecting layers and this sealing compound deters the operator from separating the cut can lid 14 from the can wall 12.

Figure 5:
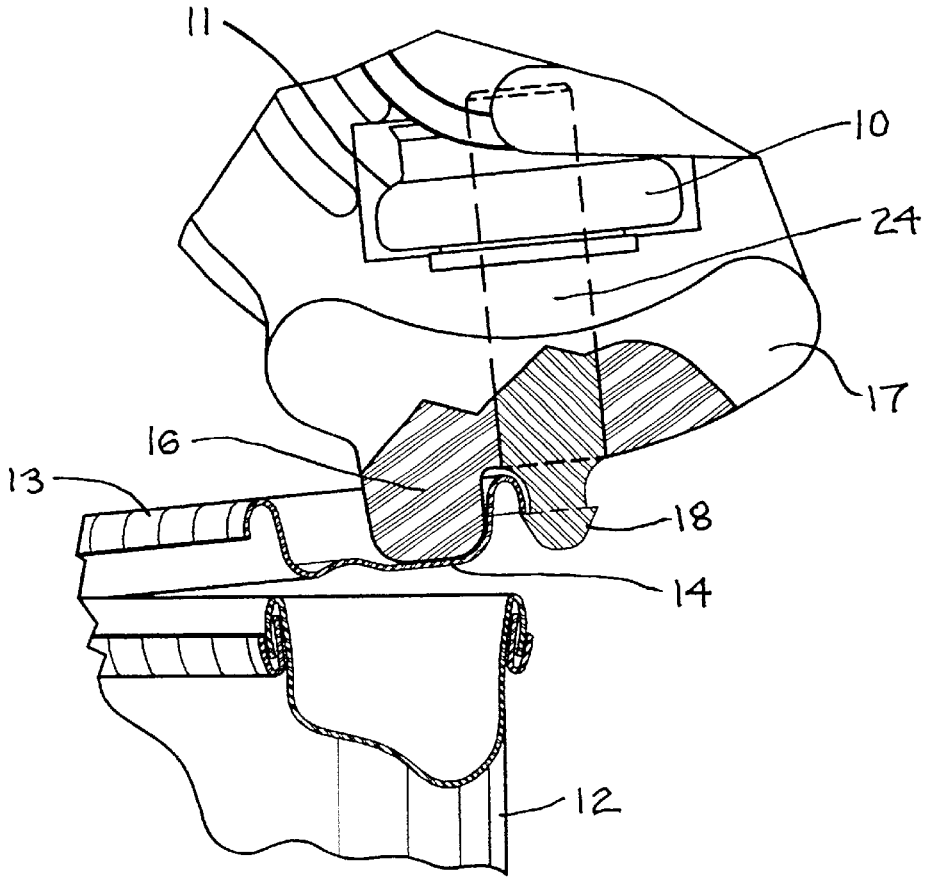
FIG. 5 illustrates a detailed cut-away partial section view of the can lid lifter lifting a cut lid and seam from the top of a can.

FIG. 5 illustrates a detailed cut away partial section view of the can lid lifter lifting a cut lid and seam from the top of a can. As seen in FIG. 5, the manner in which the lid top contact 16 fits snugly against the interior side of the can seam 13, and the "inverted mushroom" end of the lid lifting pin 18 contacts and catches the underside of the exterior of the seam 13, are illustrated in detail. Once the lid top contact 16 and lid lifting pin 18 are secured to the seam 13 of the lid 14, leverage is provided and it is easy for the operator to lift the lid 14 from the can 12. The edge of the lid top contact 16 that is proximate to the seam 13 is curved so that it more closely conforms with the interior curve of the seam 13. FIG. 5 also illustrates how the lid lifting pin 18 is conveniently machined into the bottom end of the cutting wheel shaft 24, upon which the cutting wheel blade 10 is also mounted at the upper end (see also FIG. 4).

Figure 6:
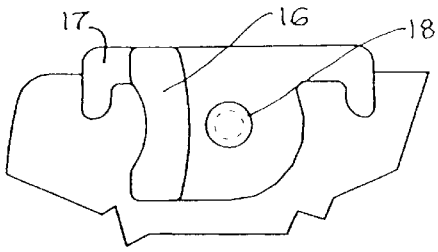
FIGS. 6 to 11 illustrate bottom views of alternative designs of a can lifting pin.
Figure 7:
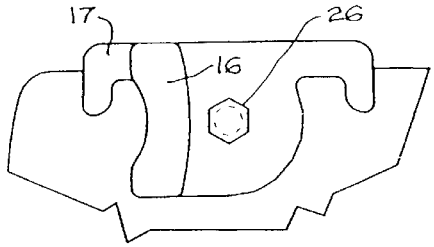
Figure 8:
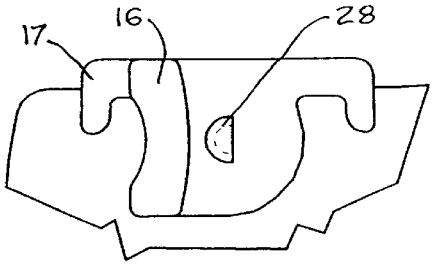
Figure 9:
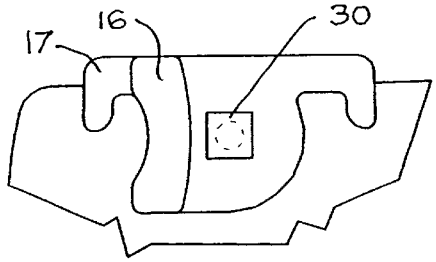
Figure 10:
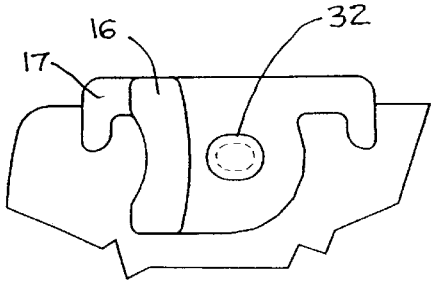
Figure 11:
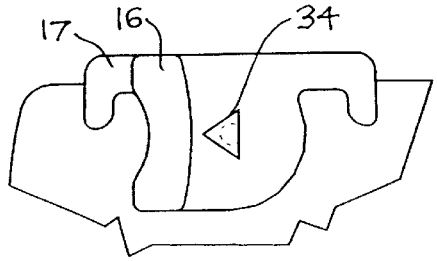

FIGS. 6 through 11 illustrate bottom views of alternative designs of a can lifting pin. FIG. 6 illustrates the most common design of the lid lifting pin 18, which as shown in FIG. 5 previously, is machined into the bottom end of the cutting wheel shaft 24. The curved edge can seam conforming pattern of the lid top contact 16 is also illustrated. This curve in congruent with the interior edge of the curved seam 13 of a typical food can. FIG. 6 also illustrates the can contact face 17, which abuts the wall of the can 12 and assists in securing the can opener 2, with its cutting wheel 10 and traction wheel 20 in position against the can seam 13 (not shown) for optimum shearing action of the lid 14 from the can 12. FIGS. 7 through 11 show alternative designs of lid lifting pins, including hexagonal 26 as seen in FIG. 7, semi-circular 28 as seen in FIG. 8, square 30 as seen in FIG. 9, oval 32 as seen in FIG. 10 and triangular 34 as seen in FIG. 11.

Figure 12:
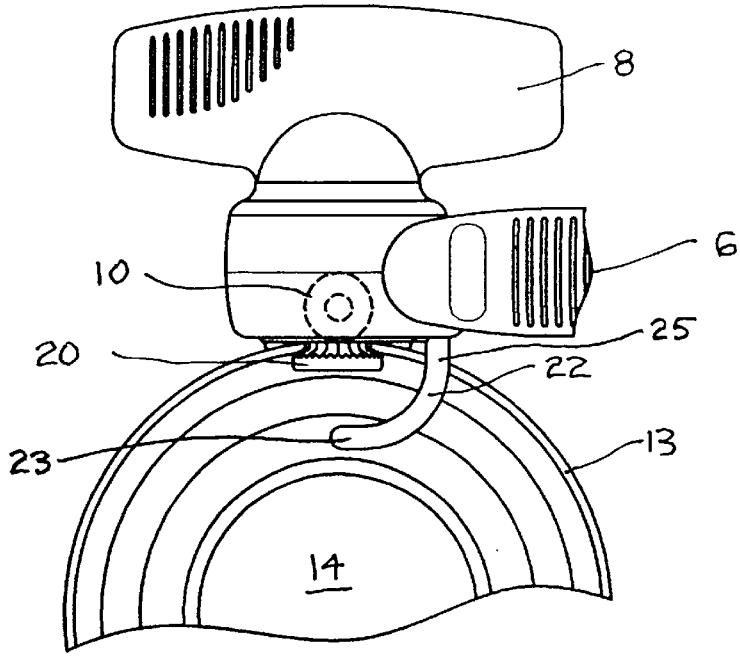
FIG. 12 illustrates a top view of the can opener contacting the top seam of a can with a traction wheel, cutting wheel and J-shaped can abutment.

FIG. 12 illustrates a top view of the hand operated can opener contacting the top seam of a can with a traction wheel, cutting wheel and J-shaped can abutment. FIG. 12 is of assistance in illustrating the unique design of the J-shaped can abutment 22, and how at its upper end 25 (as seen in FIG. 12) it contacts the top of seam 13 of the can, while at its lower distal end 23, it contacts the top surface of the can lid 14. The J-shape is advantageous because it is easy for the operator to use and quickly aligns the traction wheel 20 and cutting wheel 10 with the can 12 at the optimum can lid shearing angle (see FIG. 3).

Figure 13:
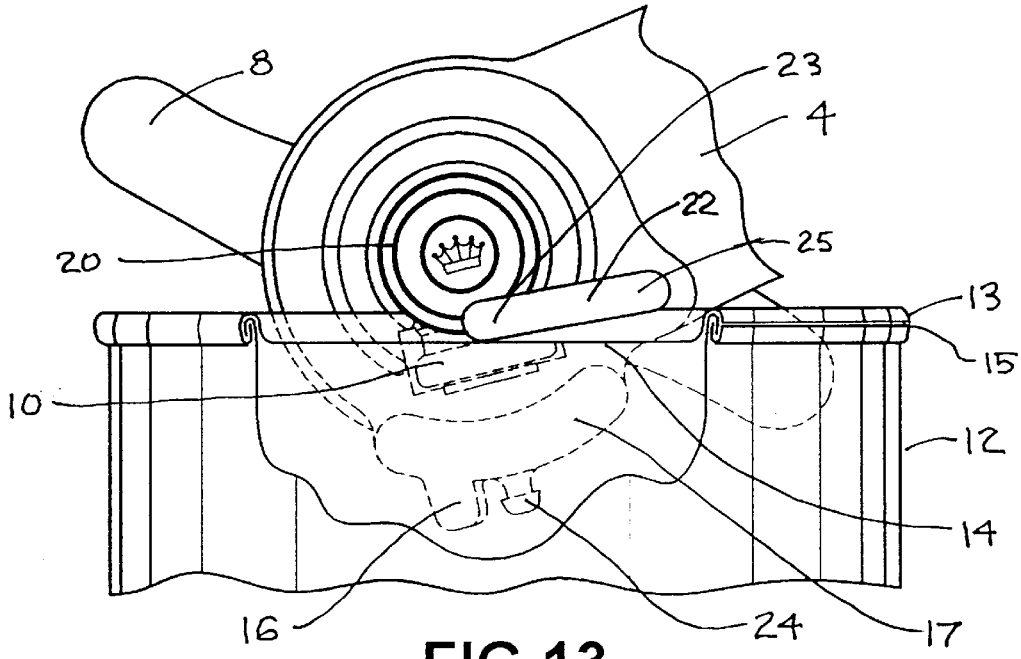
FIG. 13 illustrates a detailed side partial cut-away view of the can opener engaging the top seam of a can, with the J-shaped can abutment contacting the top of the can and the cutting wheel disposed at an angle to shear a cut in the top seam of the can.

FIG. 13 illustrates a detailed side partial cut-away view of the hand operated can opener engaging the top seam of a can, with the cutting wheel disposed at an optimum angle to shear a cut in the top seam of the can. FIG. 13 is helpful in that it discloses the manner in which the J-shaped can abutment 22 at the interior end 25 contacts the top edge of can seam 13, while at its lower distal end 23, contacts the top surface of lid 14, thereby ensuring that the cutting wheel 10 and traction wheel 20 are oriented in optimum angle position for maximum and efficient shearing action of the lid 14 from the can 12. In use, the cutting wheel 10, by turning at an angle, shears the can seam 13 rather than cutting it. This action is more efficient and long lasting than a cutting blade which is level with the can lid 14. The lid top contact 16, can contact face 17 (which bears against the can wall 12 and prevents the cutting wheel 10 and traction wheel 20 from twisting to the side) and lid lifting pin 18 are also shown in dotted lines.

Figure 14:
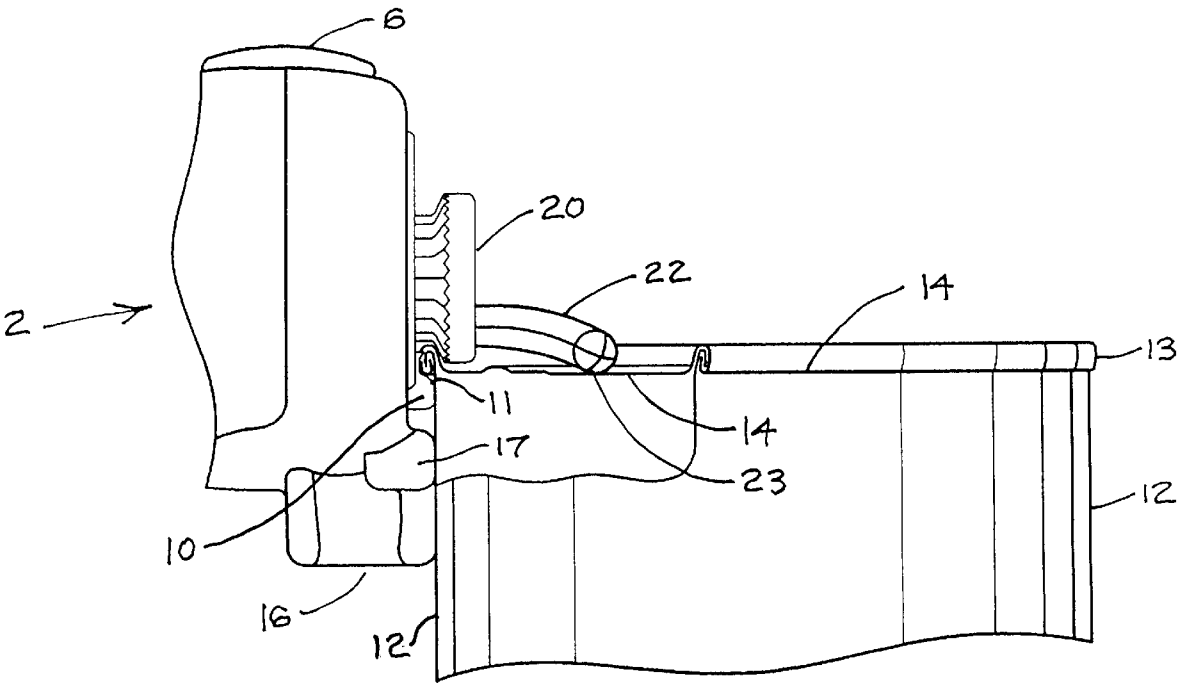
FIG. 14 illustrates an end partial cut-away view of the can opener with traction wheel and J-shaped can abutment contacting the top seam and top lid of a can.

FIG. 14 illustrates an end partial cut-away view of the can opener with traction wheel and J-shaped can abutment contacting the top seam and top lid of a can. The important thing to note in FIG. 14 is that through a combination of the J-shaped can abutment 22, which simultaneously contacts the top of seam 13 and at its distal end 23 the top of lid 14, the underseam contact edge 11 of wheel cutting blade 10, which bears against the underside of the can seam 13, and the right angle orientation of can contact face 17 and lid top contact 16, which together bear against can wall 12, the traction wheel 20 and cutting wheel 10 (not shown) are assured of being properly oriented and staying in position for maximum and efficient shearing action. The can 12 does not wiggle free or drop in elevation and is always maintained in right angle orientation with the top edge of the can 12 and lid 14 at the seam 13, to thereby ensure maximum and efficient shearing action of the cutting wheel 10 on the seam 13, as the opener 2 advances around the circumference of the seam 13, by the operator turning hand crank 8 (not shown).

Figure 15:
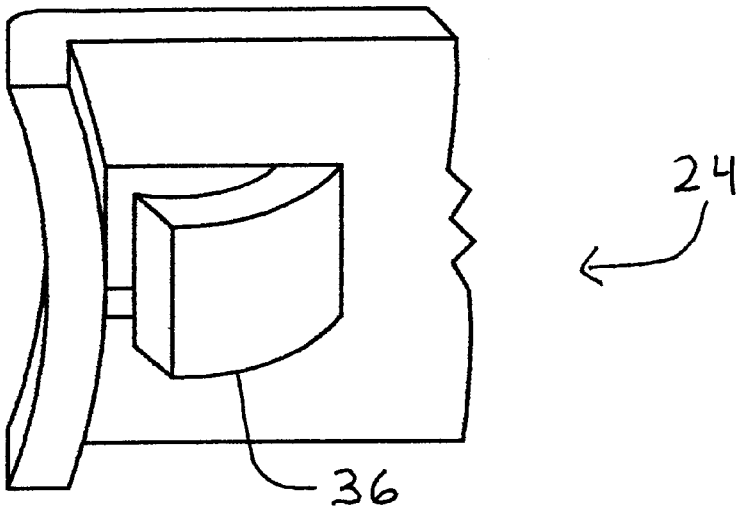
FIG. 15 illustrates a bottom isometric view of an alternative embodiment of the invention wherein the can lifter pin is a bottle cap opening hook.
Figure 16:
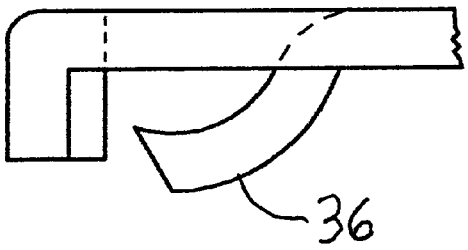
FIG. 16 is an elevation view of the bottle cap opening hook.

FIG. 15 illustrates a bottom isometric view of an alternative embodiment of the invention wherein the can lifter pin 24 is a bottle cap opening hook 36. FIG. 16 is an elevation view of the bottle cap opening hook 36.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A can opener comprising:

(a) a handle;

(b) a clamping lever associated with the handle;

(c) a hand crank associated with the clamping lever and handle;

(d) a wheel cutting blade mounted on the can opener;

(e) a traction wheel which rotates when the hand crank is rotated;

(f) a can lid top contact member mounted on an exterior of the can opener for contacting the cut lid of a can; and (g) a can lid lifting pin associated with the can lid top contact member for releasably catching an edge of a cut can lid, wherein the lid lifting pin is cylindrical and has a protrusion at the distal end thereof of a diameter greater than the diameter of the cylindrical lid lifting pin.

2. A can opener as claimed in claim 3 wherein the protrusion is in the shape of a hemisphere.

3. A can lifter for use in association with a can seam cutting can opener which comprises:

(a) a can lid top contact member; and (b) a can lid lifting pin associated with the can lid top contact member, the can lid lifting pin cooperating with the can lid top contact member to grip a can lid and can seam of a cut can lid, wherein the lid lifting pin is cylindrical and has a protrusion at the distal end thereof of a diameter greater than the diameter of the cylindrical lid lifting pin.

4. A can lifter as claimed in claim 15 wherein the protrusion is in the shape of a hemisphere.

5. A can lifter as claimed in claim 15 wherein the protrusion is a hook for opening bottle caps.

* * * * *